US008715002B2

(12) United States Patent
Fitzpatrick

(10) Patent No.: US 8,715,002 B2
(45) Date of Patent: May 6, 2014

(54) MODULAR COMMUNICATIONS JACK WITH USER-SELECTABLE MOUNTING

(75) Inventor: Brian J. Fitzpatrick, McKinney, TX (US)

(73) Assignee: CommScope, Inc. of North Carolina, Hickory, NC (US)

( * ) Notice: Subject to any disclaimer, the term of this patent is extended or adjusted under 35 U.S.C. 154(b) by 437 days.

(21) Appl. No.: 13/014,943

(22) Filed: Jan. 27, 2011

(65) Prior Publication Data

US 2012/0196472 A1 Aug. 2, 2012

(51) Int. Cl.

| | |
|---|---|
| ***H01R 13/73*** | (2006.01) |
| ***H01R 13/627*** | (2006.01) |
| ***H01R 13/74*** | (2006.01) |
| ***H01R 24/64*** | (2011.01) |
| ***H01R 27/00*** | (2006.01) |

(52) U.S. Cl.

CPC ..... *H01R 13/6275* (2013.01); *H01R 13/743* (2013.01); *H01R 13/745* (2013.01); *H01R 24/64* (2013.01); *H01R 27/00* (2013.01)

USPC ..... 439/557

(58) Field of Classification Search

USPC ..... 439/389, 170, 536, 557

See application file for complete search history.

(56) References Cited

U.S. PATENT DOCUMENTS

| | | | | |
|---|---|---|---|---|
| 3,614,714 A | | 10/1971 | Silverstein | |
| 4,369,340 A | * | 1/1983 | Beatenbough | 379/454 |
| 4,376,565 A | | 3/1983 | Bird et al. | |
| 4,781,626 A | | 11/1988 | Lazarchik | |
| 5,125,852 A | | 6/1992 | Archer | |
| 5,244,402 A | * | 9/1993 | Pasterchick et al. | 439/217 |
| 5,370,556 A | | 12/1994 | Olsson | |
| 5,387,135 A | | 2/1995 | Shen et al. | |
| 5,599,206 A | | 2/1997 | Slack et al. | |
| 5,600,746 A | | 2/1997 | Arnett | |
| 5,772,466 A | | 6/1998 | Morin et al. | |
| 6,042,419 A | | 3/2000 | Liu | |
| 6,059,583 A | | 5/2000 | Croft et al. | |
| 6,186,835 B1 | | 2/2001 | Cheshire | |
| 6,244,907 B1 | | 6/2001 | Arnett | |

(Continued)

FOREIGN PATENT DOCUMENTS

WO WO 03/007433 A1 1/2003

OTHER PUBLICATIONS 1000-24LC-DPLX-LS Product Specification, dated Mar. 26, 2010.
360DP-2MPO Product Specification, dated Mar. 26, 2010.

(Continued)

*Primary Examiner* — Tho D Ta
*Assistant Examiner* — Travis Chambers
(74) *Attorney, Agent, or Firm* — Myers Bigel Sibley & Sajovec, P.A.

(57) ABSTRACT

A communications jack includes a housing having a top surface, a bottom surface, first and second opposed side surfaces, and a plug aperture configured to receive a mating plug at a front of the housing. At least one of the first side surface, the second side surface, the top surface, and the bottom surface of the housing includes a first feature configured to engage a first mounting structure associated with a first mounting opening to mount the jack in the first mounting opening. One of the top and bottom surfaces of the housing includes a second feature configured to engage an adapter to mount the jack in a second mounting opening that is different than the first mounting opening.

19 Claims, 11 Drawing Sheets

(56) References Cited

U.S. PATENT DOCUMENTS

| | | | | |
|---|---|---|---|---|
| 6,257,935 | B1 | 7/2001 | Zhang et al. | |
| 6,296,528 | B1 | 10/2001 | Roberts et al. | |
| 6,312,293 | B1 | 11/2001 | Wang | |
| 6,319,070 | B1 | 11/2001 | Tan | |
| 6,375,516 | B1 | 4/2002 | Trinh | |
| 6,416,364 | B1 | 7/2002 | Shi et al. | |
| 6,458,001 | B1 | 10/2002 | Chen et al. | |
| 6,641,443 | B1 | 11/2003 | Itano et al. | |
| 6,683,460 | B2 * | 1/2004 | Huang | 324/538 |
| 6,786,776 | B2 | 9/2004 | Itano et al. | |
| 6,890,197 | B2 | 5/2005 | Liebenow | |
| 6,935,877 | B2 * | 8/2005 | Liao | 439/170 |
| 7,037,141 | B1 | 5/2006 | Huang | |
| 7,056,157 | B2 | 6/2006 | Herring et al. | |
| 7,108,562 | B2 * | 9/2006 | Liao | 439/676 |
| 7,112,090 | B2 | 9/2006 | Caveney et al. | |
| 7,114,995 | B1 | 10/2006 | Ohshima | |
| 7,125,288 | B2 | 10/2006 | Schilling | |
| 7,189,089 | B1 * | 3/2007 | Liao | 439/170 |
| 7,287,994 | B1 * | 10/2007 | Liao | 439/172 |
| 7,311,562 | B2 | 12/2007 | Leong et al. | |
| 7,396,999 | B2 | 7/2008 | Miller et al. | |
| 7,416,413 | B2 * | 8/2008 | Liao | 439/11 |
| 7,427,218 | B1 | 9/2008 | Hashim et al. | |
| 7,670,194 | B1 | 3/2010 | Fitzpatrick | |
| 7,682,203 | B1 | 3/2010 | Pharney et al. | |
| 7,985,101 | B2 | 7/2011 | Fitzpatrick | |
| 2005/0153580 | A1 | 7/2005 | Schilling | |
| 2006/0019533 | A1 | 1/2006 | Peng | |
| 2006/0128212 | A1 | 6/2006 | Carrick | |
| 2006/0134971 | A1 | 6/2006 | Byrne | |
| 2007/0197052 | A1 * | 8/2007 | Liao | 439/11 |
| 2009/0186532 | A1 | 7/2009 | Goodrich et al. | |
| 2009/0247007 | A1 | 10/2009 | Milette | |
| 2010/0190366 | A1 | 7/2010 | Fitzpatrick | |
| 2011/0200294 | A1 | 8/2011 | Case | |

OTHER PUBLICATIONS

360DP-4MPO Product Specification, dated Mar. 26, 2010.
Assembly 360G2-48MPO, dated Sep. 30, 2009.
Assembly, 8 MPO Panel, dated Sep. 25, 2007.
International Search Report Corresponding to International Application No. PCT/US2009/069634; Dated: Mar. 9, 2010.
IP-M4200i-24 Product Specification, dated Mar. 26, 2010.
M4800-1U-GS Product Specification, dated Mar. 26, 2010.
MGS-600-262 Product Specification, dated Mar. 26, 2010.
Systimax InstaPATCH 360 System Product Brief, dated Mar. 26, 2010.
Systimax Solutions M81 Series Modular Fiber Adapter with Mounting Module Datasheet, Jan. 4, 2008.
Technical Bulletin, "Retenctin Force Technology," Leviton, 2007, Circle Card Reader #131.
Z-Max 6A Shielded Outlets, Product Information, Rev. A 4/09, retrieved from the World Wide Web http://www.siemon.com, 2 pages.
The International Search Report and the Written Opinion for PCT/US2012/021960 mailed Apr. 16, 2012.

* cited by examiner

MODULAR COMMUNICATIONS JACK WITH USER-SELECTABLE MOUNTING

FIELD OF THE INVENTION

The present invention relates generally to communications jacks and, more particularly, to communications jacks that are adaptable to be mounted in different mounting openings.

BACKGROUND

Many hardwired communications systems use plug jack connectors to connect a communications cable to another communications cable or to a piece of equipment such as a computer, printer, server, switch or patch panel. By way of example, high speed communications systems routinely use such plug-jack connectors to connect computers, printers and other devices to local area networks and/or to external networks such as the Internet. FIG. 1 depicts a simplified example of such a hardwired high speed communications system that illustrates how plug-jack connectors may be used to interconnect a computer 1 to, for example, a network server 10.

As shown in FIG. 1, the computer 1 is connected by a cable 2 to a communications jack 5 that is mounted in a mounting opening 11 of a mounting surface (shown as wall plate 9). The cable 2 is a patch cord that includes a communications plug 3, 4 at each end thereof. Typically, the cable 2 includes a plurality of wire conductors (e.g., eight), which are arranged in pairs so that each pair of conductors may carry a separate differential signal. Communications plug 3 inserts into a communications jack (not pictured in FIG. 1) provided in the back of the computer 1. Communications plug 4 inserts into an opening or "plug aperture" 6 in the front side of the communications jack 5 so that the contacts of the communications plug 4 mate with respective contacts of the communications jack 5 (if the cable 2 includes eight conductors, the communications plugs 3, 4 and the communications jack 5 will typically each have eight contacts). The communications jack 5 includes a wire connection assembly 7 at the back end thereof that receives a plurality of conductors (e.g., eight) from a second cable 8 that are individually pressed into slots in the wire connection assembly 7 to establish mechanical and electrical connections between each conductor of the second cable 8 and a respective one of a plurality of conductive paths through the communications jack 5. The other end of the second cable 8 is connected to a network server 10 which may be located, for example, in a telecommunications closet of a commercial office building. Thus, the patch cord 2, the cable 8 and the communications jack 5 provide a plurality of electrical paths (e.g., four differential signal paths) between the computer 1 and the network server 10. Each of these electrical paths may be used to communicate electrical information signals between the computer 1 and the network server 10. It will be appreciated that typically one or more patch panels or switches, along with additional communications cabling, would be included in the electrical path between the second communications cable 8 and the network server 10. However, for ease of description, these additional elements have been omitted from FIG. 1 and the second communications cable 8 is instead shown as being directly connected to the server 10.

In the above example, the jack 5 is shaped and sized to fit within the mounting opening 11. However, mounting surfaces such as wall plates and patch panels may define a variety of differently shaped and sized mounting openings, and a differently shaped and sized jack may be required for proper and secure mounting in each different mounting opening. For example, a keystone-style mounting opening may be provided instead of the mounting opening 11 illustrated in FIG. 1, and a jack that is configured differently than the jack 5 is required for proper and secure mounting in the keystone-style mounting opening. Unfortunately, the plurality of different mounting openings increases the number of jacks that need to be manufactured and maintained in inventory.

Thus, there is a need for communications jacks that are configured to be mounted within one mounting opening and adaptable to be mounted into at least one other, different mounting opening.

SUMMARY

According to some embodiments of the present invention, a communications jack is provided that includes a housing having a top surface, a bottom surface, first and second opposed side surfaces, and a plug aperture configured to receive a mating plug at a front of the housing. At least one of the top surface, the bottom surface, the first side surface, and the second side surface of the housing includes a first feature configured to engage a first mounting structure associated with a first mounting opening to mount the jack in the first mounting opening. At least one of the top surface and the bottom surface of the housing includes a second feature configured to engage an adapter to mount the jack in a second mounting opening that is different than the first mounting opening.

In some embodiments, the first feature is on at least one of the first and second side surfaces of the housing. The first feature may comprise a recess or aperture sized and configured to receive a tab of the first mounting structure associated with the first mounting opening. In some embodiments, the second feature is on the top surface of the housing. The second feature may comprise at least one slot positioned at a rear portion of the housing. An adapter may be provided in combination with the communications jack. The adapter may include opposite proximal and distal ends, with the proximal end including at least one downwardly extending projection sized and configured to engage the at least one slot, and with the distal end including an upwardly extending latch configured to engage at least a portion of the second mounting opening.

According to further embodiments of the present invention, a communications jack assembly is provided, with the assembly including a communications jack and a first adapter. The communications jack includes a housing having a top surface, a bottom surface, first and second opposed side surfaces, and a plug aperture configured to receive a mating plug at a front of the housing. At least one of the first side surface, the second side surface, the top surface, and the bottom surface of the housing includes a first feature configured to engage a first mounting structure associated with a first mounting opening to mount the jack in the first mounting opening. The first adapter is configured to engage a second feature on one of the top and bottom surfaces of the housing to mount the jack in a second mounting opening that is different than the first mounting opening.

In some embodiments, the communications jack assembly includes a cable termination manager that is attachable to the rear of the jack housing to hold the first adapter firmly in place. The jack may include a plurality of insulation displacement contacts (IDCs), with each IDC having a slot for receiving therein a conductor, and the cable termination manager may include a plurality of passageways, with each passageway configured to hold therein a conductor. When the cable termination manager is attached to the jack, each passageway is aligned with a respective IDC.

In some embodiments, the communications jack assembly includes a second adapter attachable to the front of the housing to mount the jack to a third mounting opening that is different than the first and second mounting openings. The second adapter may have a top, first and second opposed sides, and a front defining an aperture. When attached, the second adapter top extends along at least a portion of a length of the housing top surface, the second adapter first side extends along at least a portion of a length of the housing first side surface, the second adapter second side extends along at least a portion of a length of the housing second side surface, and the second adapter front aperture substantially aligns with the plug aperture of the housing. The housing may include a recess on each of the first and second side surfaces of the housing, and each of the first and second sides of the second adapter may include an inwardly extending tab sized and configured to engage at least a portion of a respective recess. Each of the first and second sides of the second adapter may include a cantilevered arm to engage at least a portion of the third mounting opening.

According to further embodiments of the present invention, a communications jack assembly is provided, with the assembly including a communications jack and an adapter. The communications jack includes a housing having a top surface, a bottom surface, first and second opposed side surfaces, and a plug aperture configured to receive a mating plug at a front of the housing. At least one of the first side surface, the second side surface, the top surface, and the bottom surface of the housing includes a first feature configured to engage a first mounting structure associated with a first mounting opening to mount the jack in the first mounting opening. The adapter is configured to engage a second feature on one of the top and bottom surfaces of the housing to mount the jack in a keystone-style mounting opening that is different than the first mounting opening.

It is noted that any one or more aspects or features described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

DETAILED DESCRIPTION

Figure 1:
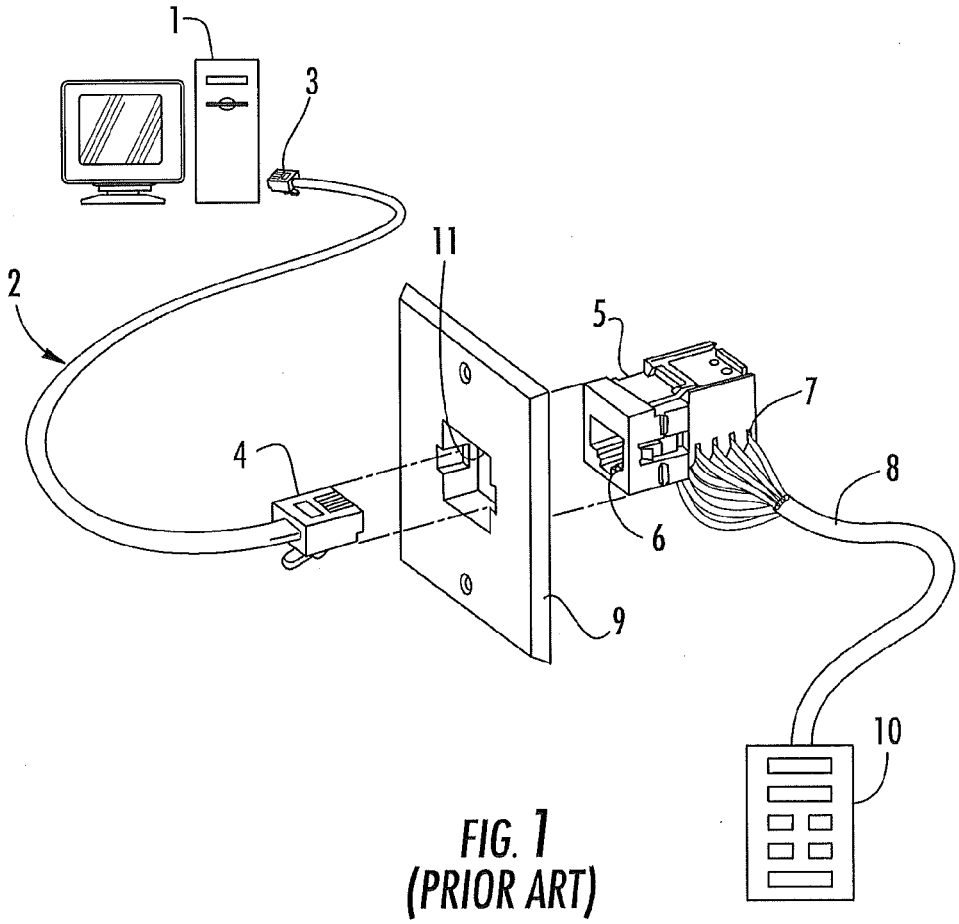
FIG. 1 (PRIOR ART)
FIG. 1 is a simplified schematic diagram illustrating the use of conventional communications plugs and jacks to interconnect a computer with network equipment.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Well-known functions or constructions may not be described in detail for brevity and/or clarity.

Unless otherwise defined, all technical and scientific terms used herein have the same meaning as commonly understood by one of ordinary skill in the art to which this invention belongs. The terminology used in the description of the invention herein is for the purpose of describing particular embodiments only and is not intended to be limiting of the invention. As used in the description of the invention and the appended claims, the singular forms "a," "an" and "the" are intended to include the plural forms as well, unless the context clearly indicates otherwise. As used herein, the term "and/or" includes any and all combinations of one or more of the associated listed items. Where used, the terms "attached," "connected," "interconnected," "contacting," "coupled," "mounted," "overlying" and the like can mean either direct or indirect attachment or contact between elements, unless stated otherwise.

Spatially relative terms, such as "top," "bottom," "side," "upper," "lower" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

As used herein, the term "mounting opening" means an opening associated with a mounting surface such as a patch panel, faceplate, wall plate, or the like. The mounting opening may be defined by the mounting surface itself and/or by structures adjacent to or attached to the mounting surface.

Figure 2:
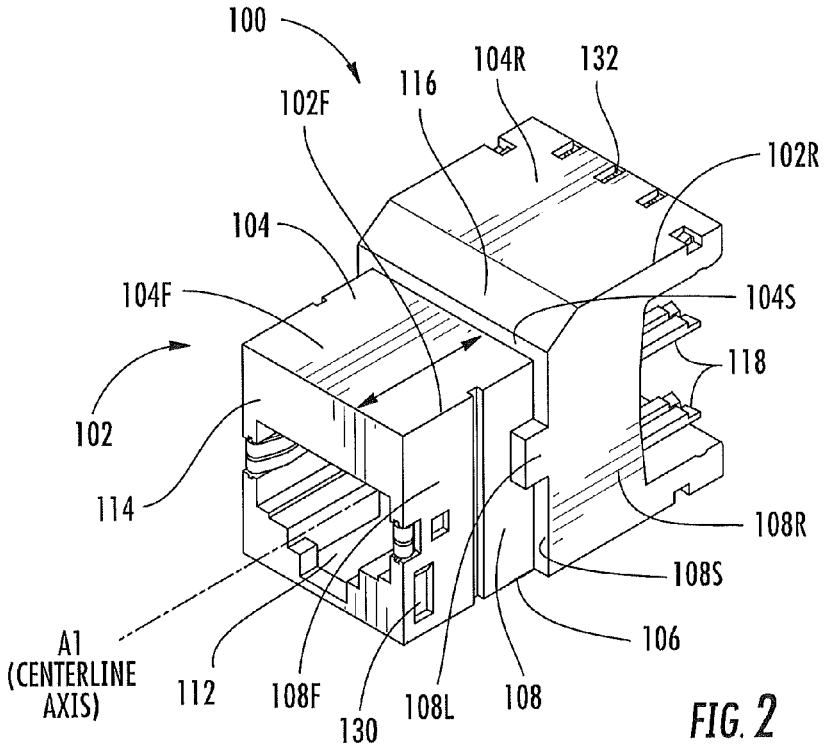
FIG. 2 is a front perspective view of a communications jack according to embodiments of the present invention.
Figure 3:
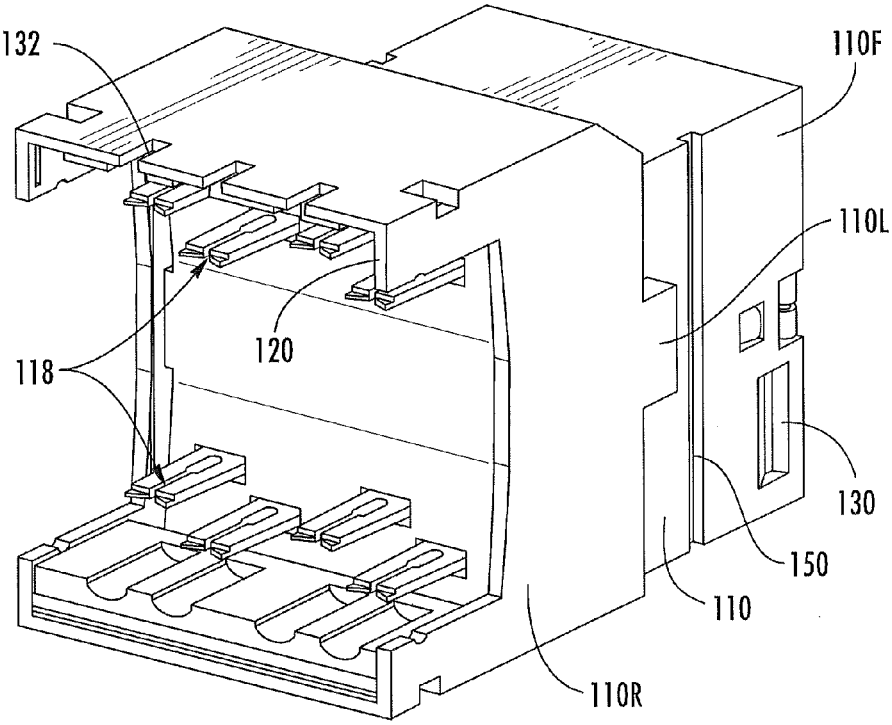
FIG. 3 is a rear perspective view of the communications jack of FIG. 2.

Turning now to the figures, a communications jack 100 is illustrated in FIGS. 2 and 3. The jack 100 includes a housing 102 that has a top surface 104, a bottom surface 106, and first and second opposed side surfaces 108, 110. The housing 102 includes a front portion 102F and a rear portion 102R. The front portion 102F of the housing 102 includes a front portion 104F of the top surface 104, a front portion 108F of the first side surface 108, and a front portion 110F of the second side surface 110. The rear portion 102R of the housing 102 includes a rear portion 104R of the top surface 104, a rear portion 108R of the first side surface 108, and a rear portion 110R of the second side surface 110.

The housing 102 also has a plug aperture 112 that is configured to receive a mating plug (not shown) at a front 114 of the housing 102. A centerline of the plug aperture 112 defines a longitudinal axis A1 along which the plug is received. The plug aperture 112 may be configured to receive, for example, an RJ-45 style communications plug.

The top surface 104 and/or the side surfaces 108, 110 may be stepped and include steps 104S, 108S, 1105. The step 104S may divide the front and rear portions 104F, 104R of the top surface 104. Similarly, the step 1085 may divide the front and rear portions 108F, 108R of the first side surface 108 and the step 1105 may divide the front and rear portions 110F, 110R of the second side surface 110. In the illustrated embodiment, the top surface 104 includes a sloped portion 116 adjacent the step 1105.

The first side surface 108 may include a ledge 108L, which may extend from the step 108S into the front portion 108F of the first side surface 108. A similar ledge 110L may be included on the second side surface 110 (FIG. 3).

The jack 100 includes a plurality of insulation displacement contacts (IDCs) 118, with each IDC 118 having a distal end that extends inside the housing rear portion 102R toward a rear 120 of the housing 102. Each IDC can include a pair of prongs, and physical and electrical contact can be made between a conductor and an IDC by urging the conductor between the prongs of the IDC. Opposed portions of the prongs can cut through insulation disposed around the conductor, thereby making electrical contact.

As illustrated, the housing may include an upper grouping or row of four IDCs 118 and a lower grouping or row of four IDCs 118. The IDCs 118 in each grouping or row may be staggered; that is, two non-adjacent IDCs 118 of each row may be at a first height relative to the bottom surface 106 of the housing 102 and the remaining two non-adjacent IDCs 118 of each row may be at a second height relative to the bottom surface 106 of the housing 102. Put another way, two non-adjacent IDCs 118 of each row may be positioned a first distance from either the top surface 104 or the bottom surface 106 of the housing 102 and the remaining two non-adjacent IDCs 118 of each row may be positioned a second, different distance from the same surface. Other arrangements of IDCs may also be employed.

Figure 5:
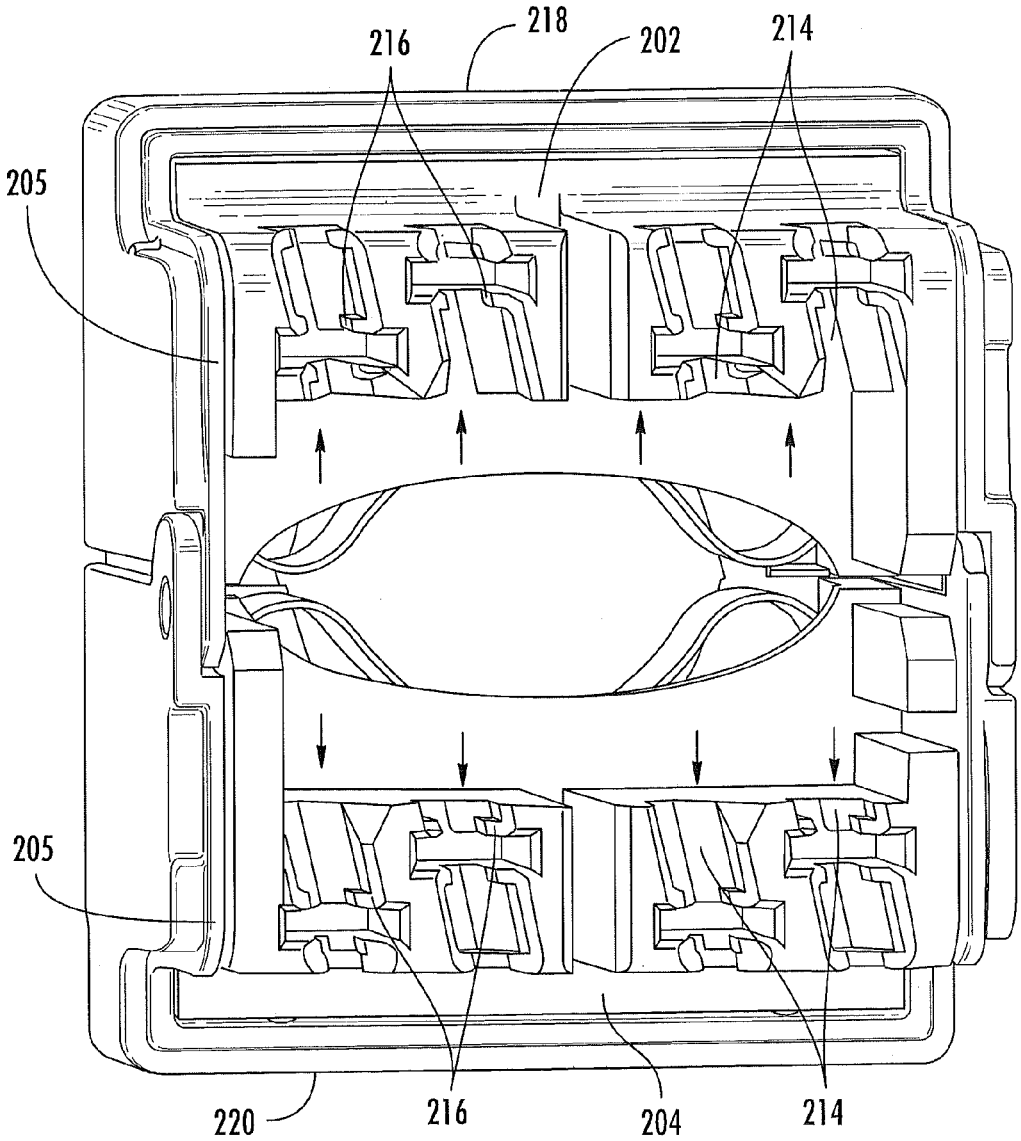
FIG. 5 is a front perspective view of the cable termination manager of FIG. 4, with the pieces snapped together.
Figure 6:
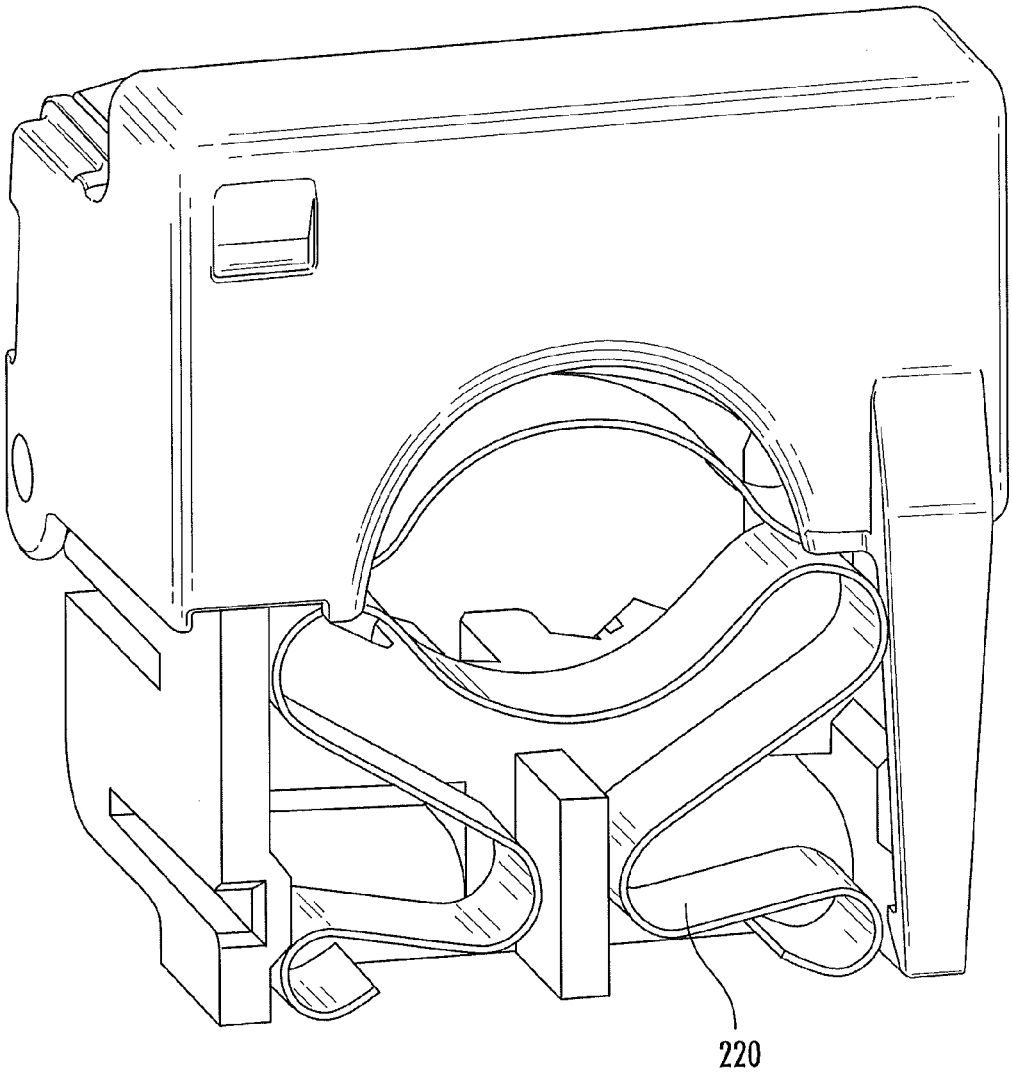
FIG. 6 is a rear perspective partial cutaway view of the cable termination manager of FIG. 4.
Figure 7:
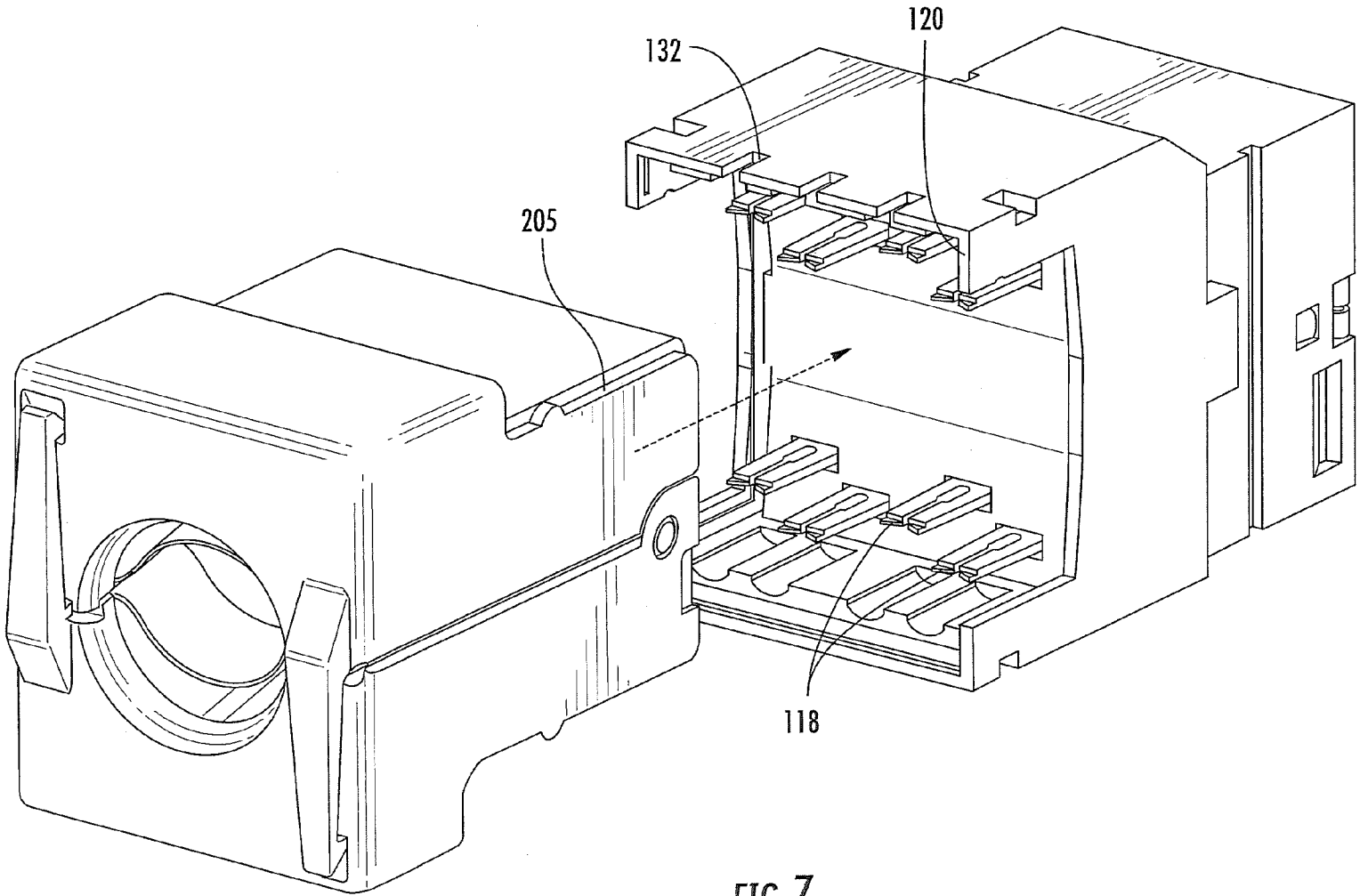
FIG. 7 is a rear perspective view of the cable termination manager of FIG. 4 in position to be attached to the communications jack of FIG. 2.

Turning to FIGS. 4-7, a cable termination manager 200 may be attachable to the rear 120 of the jack housing 102. The termination manager 200 includes first and second pieces 202, 204 that are pivotably attached at their sides by a pair of hinges 206. As such, the termination manager 200 can be in an open position when the pieces 202, 204 are moved away from each other (FIG. 4) and a closed position when the pieces 202, 204 are moved toward each other (FIG. 7). Each piece 202, 204 includes an arm 208 and an aperture or recess 210. A proximal end of each arm 208 is attached to a rear 203 of a respective piece 202, 204 and a distal end of each arm 208 includes a latch 212. The apertures 210 and the latches 212 are sized and configured such that a latch 212 of one of the pieces 202, 204 can be received in an aperture 210 of the other of the pieces 202, 204 to retain the termination manager 200 in the closed position (FIG. 7).

Referring to FIG. 5, each piece 202, 204 includes four passageways 214, with each passageway 214 sized and configured to receive a conductor in the direction shown by the arrows in FIG. 5. A telecommunications cable having four twisted conductor pairs can be routed between and past the rears 203 of the first and second pieces 202, 204 and toward a front 205 of the first and second pieces 202, 204. Two twisted conductor pairs can be routed upwardly toward the passageways 214 of the first piece 202 and two twisted conductor pairs can be routed downwardly toward the passageways 214 of the second piece 204. The conductors of the twisted pairs can then be untwisted and each conductor inserted into a passageway 214 (e.g., the untwisted conductors of a pair may be inserted into adjacent passageways 214.).

The width of at least a portion of each passageway 214 may generally be larger than the diameter of a conductor to allow the conductor to be inserted therein. Each passageway 214 includes at least one projection 216 which effectively narrows the passageway 214 to a width that is slightly less than the diameter of the conductor. The conductor may routed into the passageway 214 and then urged into the more narrow portion defined by the at least one projection 216. In this regard, the passageway 214 together with the projection 216 can secure or snugly hold the conductor. As illustrated, each passageway 214 may include a plurality of projections 216 to secure or snugly hold the conductor in the passageway 214.

The at least one projection 216 associated with a particular passageway 214 may be at a different height than the at least one projection 216 associated with an adjacent passageway 214. That is, the projections 216 associated with two non-adjacent passageways 214 of the first piece 202 may be positioned a first distance from a top 218 of the first piece 202 and the projections 216 associated with the remaining two non-adjacent passageways 214 of the first piece 202 may be positioned a second, different distance from the top 218 of the first piece 202. Similarly, the projections 216 associated with two non-adjacent passageways 214 of the second piece 204 may be positioned a first distance from a bottom 220 of the second piece 204 and the projections 216 associated with the remaining two non-adjacent passageways 214 of the second piece 204 may be positioned a second, different distance from the bottom 220 of the second piece 204. Thus, conductors may be held or secured within adjacent passageways 214 at differing heights or distances relative to where they are inserted into the passageways 214.

Figure 8:
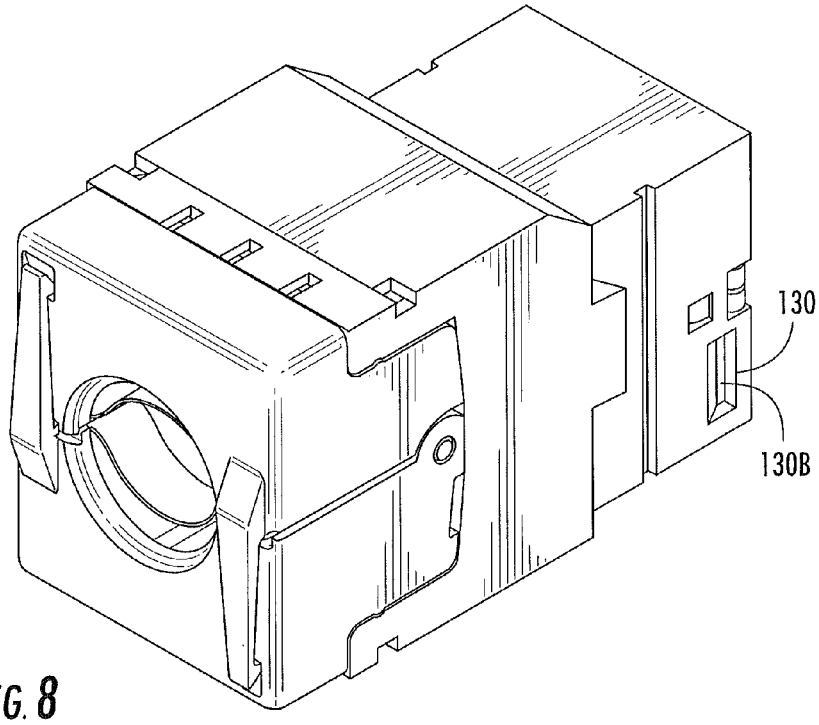
FIG. 8 is a rear perspective view of the cable termination manager of FIG. 4 attached to the communications jack of FIG. 2.

As shown in FIG. 7, the termination manager 200 may be aligned with and attached to the rear 120 of the jack housing 102. The front 205 of the termination manager 200 and the rear 120 of the jack housing 102 may be contoured or shaped such that the termination manager 200 and the jack 100 mate together when attached (FIG. 8). The top 218 of the first piece 202 may be substantially flush with the housing top rear surface 104R and the bottom 220 of the second piece 204 may be substantially flush with the housing bottom surface 106.

The positioning of the projections 216 within the passageways 214, as described above, allows individual conductors held therein to be aligned with individual IDCs 118 of the jack 100 when the termination manager 200 and the jack 100 are attached.

When in an open position, the cable termination manager 200 may allow a user to more easily route the conductors past the rears 203 and into respective passageways 214. The cable termination manager 200 may then be closed or snapped together such that it can be conveniently pushed onto the rear 120 of the jack housing 102 to terminate the conductors at the aligned IDCs 118.

Figure 4:
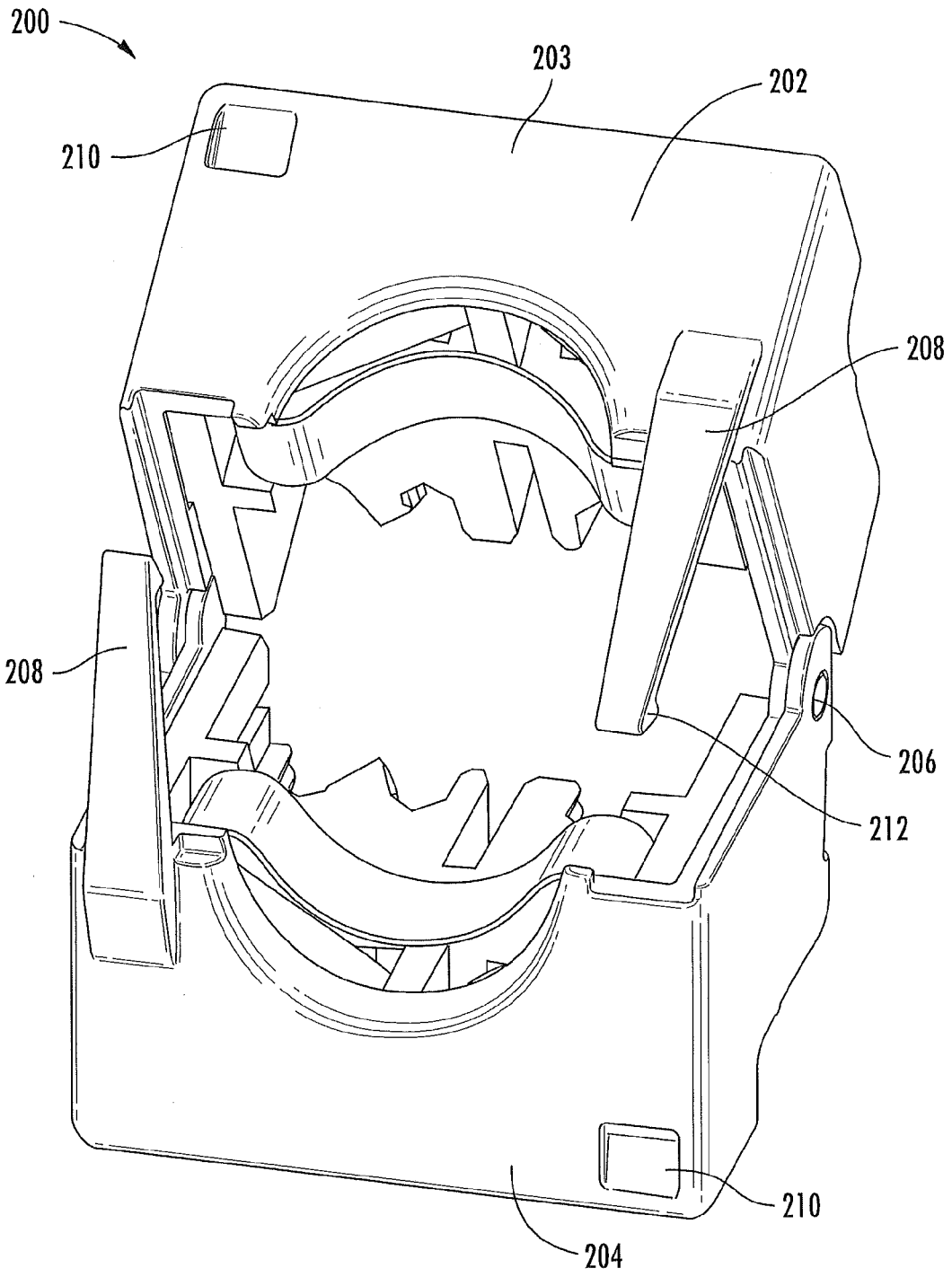
FIG. 4 is a rear perspective view of a cable termination manager according to embodiments of the present invention, with the pieces separated to facilitate insertion of a cable.

As best seen in FIGS. 4 and 6, a spring 220 may be positioned within each piece 202, 204. The springs 220 may be configured to provide an electrical contact between a shield of a cable and a shield of the jack (e.g., at least a portion of the jack housing 102, which may be metal).

Referring to FIGS. 2, 3, 7 and 8, at least one of the first side surface 108, the second side surface 110, the top surface 104, and the bottom surface 106 of the jack housing 102 can include a first feature or engagement mechanism configured to engage a mounting structure associated with a mounting opening to mount the jack 100 in the mounting opening. For example, the first feature may comprise at least one aperture or recess on one or more of the surfaces 104, 106, 108, 110. In the illustrated embodiments, the first feature comprises a recess 130 on each of the housing side surfaces 108, 110.

Figure 9:
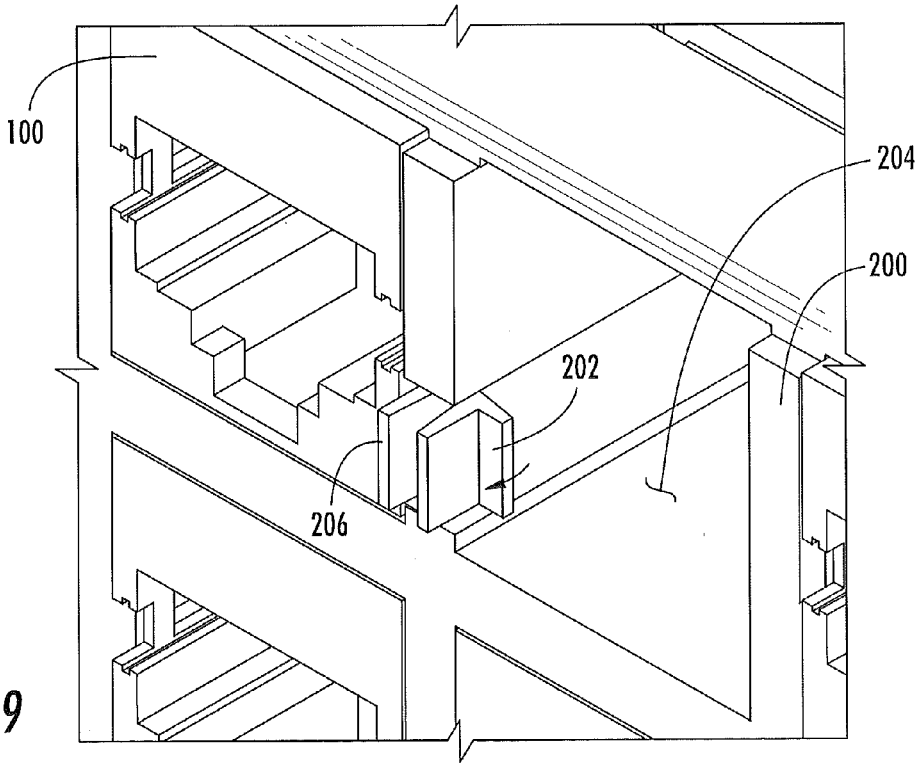
FIG. 9 is a front perspective view of a patch panel having a plurality of mounting openings and the communications jack of FIG. 2 mounted in one of the openings.

As illustrated in FIG. 9, the recess 130 may be sized and configured to receive a tab 202 associated with a high-density patch panel 200. The patch panel 200 includes a plurality of openings 204, with a jack 100 insertable from a rear of the patch panel 200 into each opening 204. At least one tab 202 is positioned relative to each opening 204 such that a distal end of the tab 202 extends into the opening 204 near a front of the patch panel 200. The tabs 202 may be made of a resilient material; as such, each tab 202 may have a resting position as illustrated in FIG. 9 and may be resiliently deflected such that the distal end of the tab 202 extends toward the front of the patch panel 200, as indicated by the arrow.

As a jack 100 is inserted into an opening 204 at the rear of the patch panel 200 and pushed forward, the tab 202 associated with the opening 204 may be deflected or pushed forward by the front 114 and/or the sides 108, 110 of the jack housing 102 (FIGS. 2 and 3). As the jack 100 is pushed further forward, the tab 202 eventually slips into the recess 130, allowing the tab 202 to return to its resting position. As shown in FIG. 8, the recess 130 may include a base portion 130B that is sized and configured to engage the distal end of the tab 202 and thereby securely hold the tab 202 therein.

The jack 100 may be inhibited from moving backward toward the rear of the patch panel 200 due to the engagement of the tab 202 and the recess 130. For example, the engagement of the tab 202 and the recess 130 may inhibit backward movement of the jack 100 as a communications plug is inserted into the plug aperture 112.

Engagement of the tab 202 and the recess 130 may provide the user with tactile and/or audible feedback to indicate that the jack 100 has been inserted a proper distance into the opening 204. Also, the steps 104S, 108S, 110S and/or the ledges 108L, 110L of the jack housing 102 (FIGS. 2 and 3) may be sized and positioned such that they abut or contact the rear of the patch panel 200 (or a rear of a structure within the opening 204) when the jack 100 has been inserted the proper distance. In this regard, the steps 104S, 108S, 110S and/or the ledges 108L, 110L may serve to prevent the jack 100 from being pushed too far forward into the opening 204.

Still referring to FIG. 9, an arm 206 may be connected to or integrated with each tab 202. The arm 206 may be substantially normal to the tab 202 such that a distal end of the arm 206 extends away from the tab 202 past the front of the patch panel 200. The arm 206 can be deflected or urged away from a respective opening 204 such that the tab 202 deflects or pivots away from its resting position in the direction of the arrow. Thus, a user may deflect or urge the arm 206 to assist removal of the jack 100 from the opening 204 (e.g., to assist in disengaging the tab 202 from the recess 130). In this regard, the arm 206 may be deflected away from the jack 100 such that the jack 100 may be more easily pulled from the rear of the patch panel 200. In addition, a user may manually deflect or urge an arm 206 away from an associated opening 204 to assist insertion of a jack 100 into the opening 104 (e.g., until the tab 202 becomes engaged in the recess 130).

It will be understood that the first feature or engagement mechanism of the jack housing 102 may enable to the jack to be mounted in a mounting opening that is different than the opening 204 associated with the high-density patch panel 200 depicted in FIG. 9. For example, the mounting opening may be associated with a wall plate. The wall plate may include a structure similar to the tab 202 to engage the recess 130. It will also be understood that the mounting surface may have a pair of structures, such as a pair of tabs 202, with each tab 202 engaging a respective recess 130 on either side surface 108, 110 of the jack housing 102. It will be further appreciated that a mounting structure could be positioned at or adjacent the top and/or the bottom of the mounting opening. For example, at least one structure similar to the tab 202 could be positioned so as to engage an aperture or recess on the top surface 104 and/or the bottom surface 106 of the jack housing 102.

At least one of the top and bottom surfaces 104, 106 of the jack housing 102 can include a second feature or engagement mechanism configured to engage an adapter to mount the jack 100 in a second mounting opening that is different than the mounting opening described above. In some embodiments, and as illustrated in FIGS. 2 and 3, the top surface 104 of the jack housing 102 can include at least one slot 132 positioned at a rear portion of the jack housing 102 (i.e., the at least one slot 132 may be positioned on the top rear surface 104R and may extend to the rear 120 of the housing 102). In other embodiments, the second feature (e.g., at least one slot 132) may similarly be positioned on the bottom surface 106 and may extend to the rear 120 of the jack housing 102.

Figure 10:
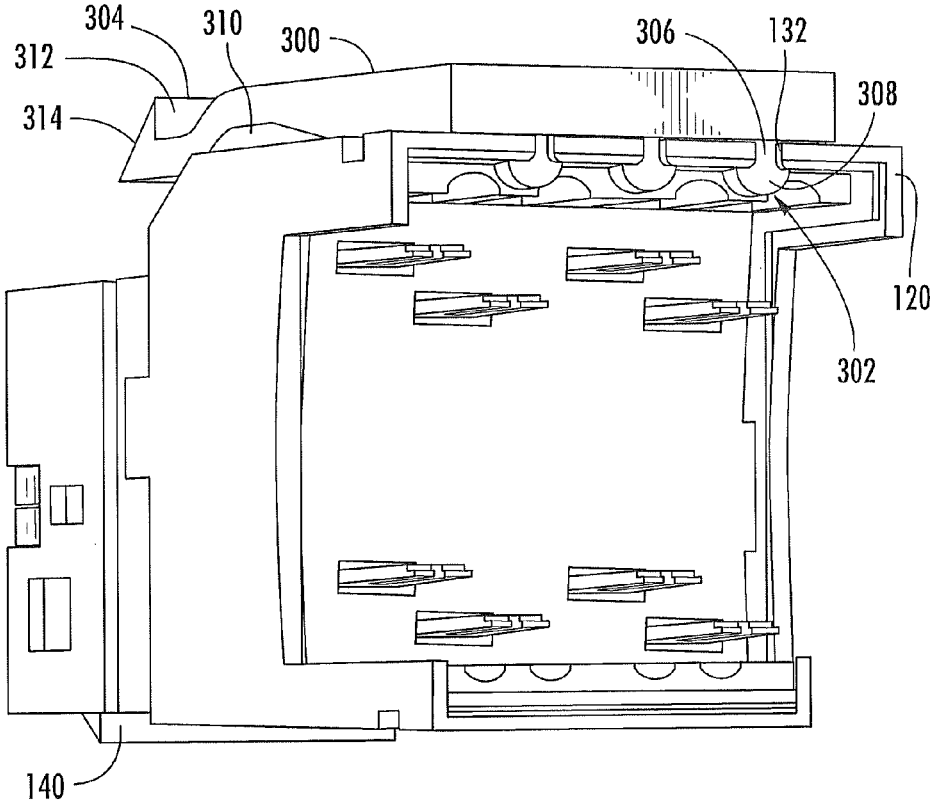
FIG. 10 is a rear perspective view of the communications jack of FIG. 2 with an adapter attached thereto.
Figure 11:
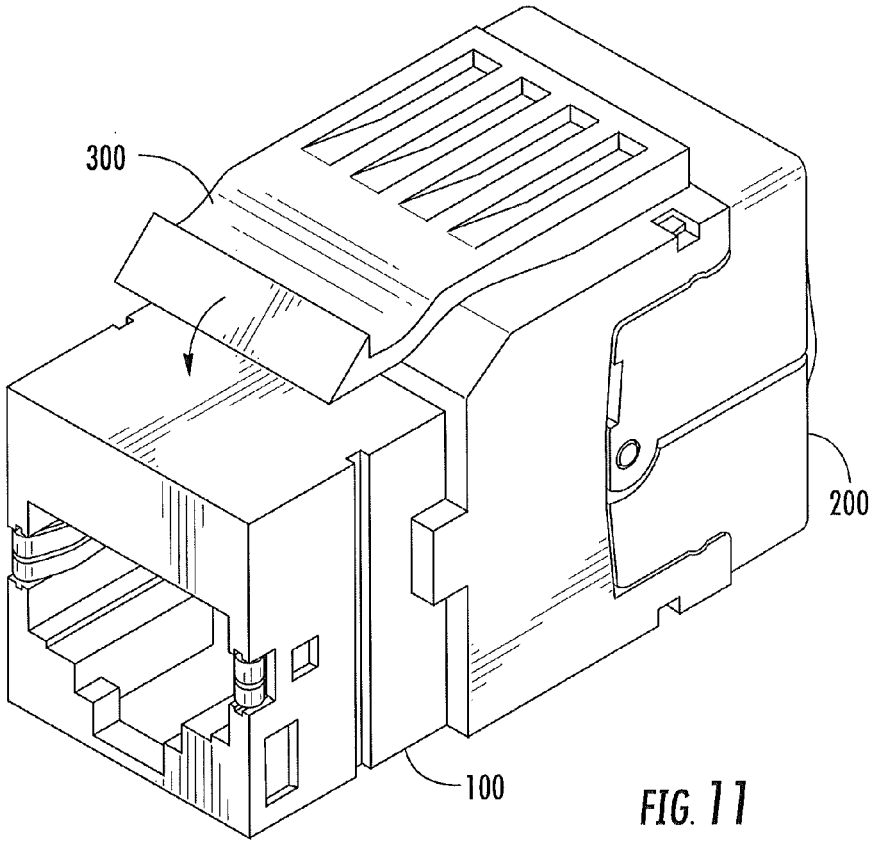
FIG. 11 is a front perspective view of the communications jack and adapter of FIG. 10 with the cable termination manager of FIG. 4 attached thereto.

Turning to FIGS. 10 and 11, an elongated adapter 300 has a first or proximal end including at least one downwardly extending projection 302 that is sized and configured to engage the at least one slot 132 of the jack housing 102. The adapter 300 also has a second or distal end including an upwardly extending latch or projection 304 configured to engage at least a portion of the second mounting opening, as will be described in more detail below.

As shown in the illustrated embodiments, the adapter 300 may include a plurality of projections 302 extending downwardly therefrom, with each projection 302 sized and configured to engage one of a plurality of slots 132 of the jack housing 102. Although the following will refer to a plurality of projections 302 engaging a plurality of slots 132, it will be understood that only one projection 302 and one slot 132 may be employed.

The projections 302 may include a first or proximal portion 306 and a second or distal portion 308. The first portion 306 is connected to a bottom surface of the adapter 300 and has a width that is about the same as a width of the slots 132. As such, the adapter 300 may be slid onto the jack housing 102 from the rear (i.e., past the rear 120) such that a friction fit is established between the projections 302 and the slots 132. The second portions 308 may be relatively wide compared to the first portions 306; in this regard, the projections 302 may take on a dovetail shape. The friction fit and/or the dovetail shape inhibits the adapter 300 from becoming disengaged, either rearwardly from the rear 120 of the housing 102 or upwardly (i.e., outwardly) away from the top surface 104 of the housing 102.

As described above, and as shown in FIG. 11, the termination device 200 may be attached to the rear 120 of the jack housing 102 to terminate conductors held in the device 200 on the IDCs. Moreover, because the termination device 200 may rest against the rear 120 of the housing 102 when attached thereto, the termination device 200 can help hold the adapter 300 in place.

When attached, a portion of the bottom surface of the adapter 300 may rest against the top rear surface 104R of the housing 102 (i.e., a portion of the bottom surface of the adapter 300 adjacent the projections 302 may rest against the top rear surface 104R). The bottom surface of the adapter 300 may include a contoured portion 310 such that, along with the step 104S and/or the sloped portion 116 of the top surface 104 of the jack housing 102, the adapter 300 is cantilevered with at least the end portion of the adapter 300 including the projection or latch 304 elevated over the top surface 104 of the housing 102. The adapter 300 may be made of a resilient material such that the end portion including the latch or projection 304 can be deflected downward (i.e., inward toward the jack housing 102) as shown by the arrow in FIG. 11. The contoured portion 310 of the adapter 300 may be sized and positioned such that, as the adapter 300 is deflected downward, the contoured portion 310 mates with or rests above the sloped portion 116 of the housing 102. In this regard, the degree to which the adapter 300 is cantilevered may depend on the amount of downward deflection of the adapter 300.

As shown in FIG. 10, the latch 304 can include an upwardly extending straight portion 312 closer to the first or proximal end of the adapter 300. The latch 304 can also include a sloped portion 314 that slopes downwardly from the straight portion 312 to the second or distal end of the adapter 300. When the adapter 300 is engaged, the latch 304 and/or the straight portion 312 may extend outwardly away from the jack housing 102.

Figure 12A:
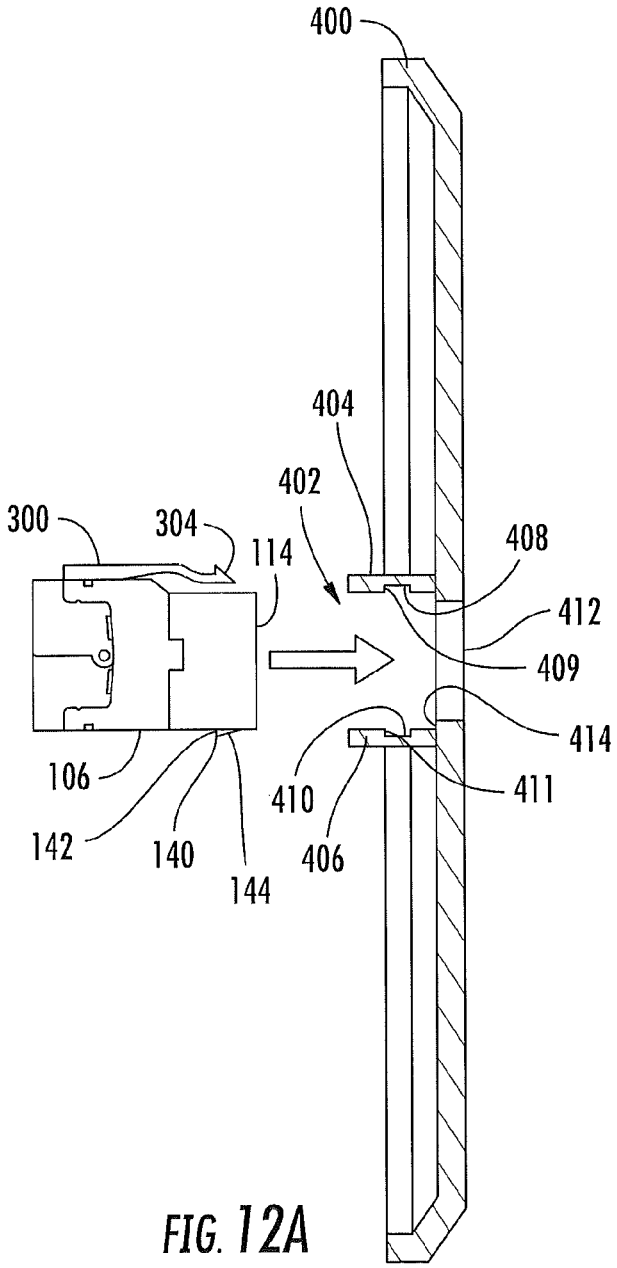
FIG. 12A is a side schematic view of the communications jack, adapter, and cable termination manager of FIG. 11 in position to be mounted in a keystone-style mounting opening.

Turning to FIG. 12A, an exemplary second mounting opening is illustrated. The opening may be a keystone-style opening 402 and, in the illustrated embodiment, is defined at least in part by a wall plate 400. It will be appreciated that keystone-style mounting openings may be defined at least in part by other types of mounting surfaces such as patch panels. Keystone-style openings are described in more detail in U.S. Pat. Nos. 6,042,419 to Liu and 7,056,157 to Herring et al., the disclosures of which are incorporated herein in their entireties. Keystone opening and latching features are also described in IEC Standard 60603-7, the disclosure of which is incorporated herein in its entirety.

The keystone opening 402 includes an upper wall 404 and a lower wall 406. The upper wall 404 includes a slot or groove 408 and the lower wall 406 also includes a slot or groove 410. Also illustrated in FIG. 12A is a side view of the jack 100 with the adapter 300 attached thereto.

It can be seen from FIG. 12A (as well as FIG. 10) that the bottom surface 106 of the jack housing 102 can include a latch or protrusion 140. A rear portion 142 of the latch or protrusion 140 extends downwardly away from the jack bottom surface 106 and a front portion 144 of the latch or protrusion 140 slopes upwardly from the rear portion 142 until it reaches the bottom surface 106 nearer the front 114 of the jack housing 102. It will be understood that the top surface 104 or the top front surface 104F of the housing 102 can include the latch or protrusion 140 in those embodiments in which the adapter 300 engages a second feature on the bottom surface 106 of the housing 102.

Still referring to FIG. 12A, the jack 100 with the adapter 300 attached thereto can be inserted into the keystone opening 402 as shown by the arrow. The latch 304 of the adapter 300 engages the slot or groove 408 and the latch or protrusion 140 engages the slot or groove 410 (it will be understood that the jack 100 could be rotated 180 degrees such that the latch 304 engages the slot or groove 410 and the latch or protrusion 140 engages the slot or groove 408). For example, the adapter 300 may deflect downwardly as the jack 100 is inserted into opening 402, and the sloped portion 314 of the latch 304 may slide along the inner portion of wall 404 until the straight portion 312 of the latch 304 reaches the slot or groove 408, at which point the adapter 300 deflects upwardly to its resting position or nearer its resting position. At this point, the straight portion 312 of the latch 304 is engaged with a downward flat surface 409 of the slot or groove 408, thereby inhibiting rearward movement of the jack 100 (for example, this may inhibit rearward movement if a communications plug is inserted into the jack 100 from the front of the wall plate 400). Moreover, during insertion of the jack 100 into the opening 402, the sloped portion 144 of the protrusion 140 (where used) may slide along the inner portion of wall until the straight portion 142 reaches the slot or groove 410, at which point the straight portion 142 is engaged with an upward flat surface 411 of the slot or groove 410, thereby further inhibiting rearward movement of the jack 100.

Figure 12B:
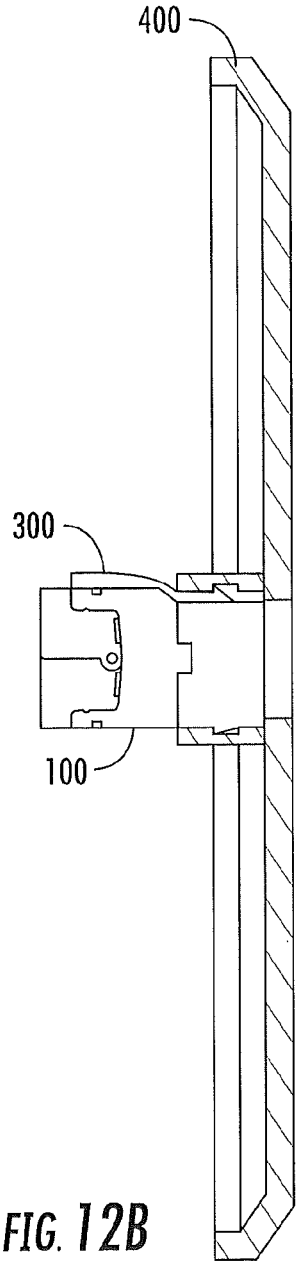
FIG. 12B is a side schematic view of the communications jack, adapter, and cable termination manager mounted in the keystone-style opening of FIG. 12A.

Once engaged, the front 114 of the jack housing 102 may abut at least one ledge 414 defined by the wall plate 400 and/or the walls 408, 410. This may inhibit further forward movement of the jack 100 after insertion. Alternatively or additionally, the ledges 108L, 110L (FIGS. 2 and 3) may inhibit forward motion of the jack after insertion. For example, the ledges 108L, 100L may abut ledges, sidewalls, or other structures within the opening 402. Aperture 412 of the faceplate 400 may be substantially aligned with aperture 112 of the jack 100 to allow a communications plug to be inserted through the aperture 412 and into aperture 112. In this regard, the jack aperture 112 may be slightly recessed with respect to faceplate aperture 412. This is the configuration shown in FIG. 12B. Alternatively, at least a portion of the front portion 102F of the jack housing 102 may reside in aperture 412 of wall plate 400 (e.g., the front 114 of the housing 102 may be flush with the front of the wall plate 400 or may protrude slightly from the front of the wall plate 400).

Turning now to FIGS. 13-16, a second adapter 500 may be attachable to the jack housing 102 to mount the jack 100 in a mounting opening that is different than the mounting openings described above.

Figure 13:
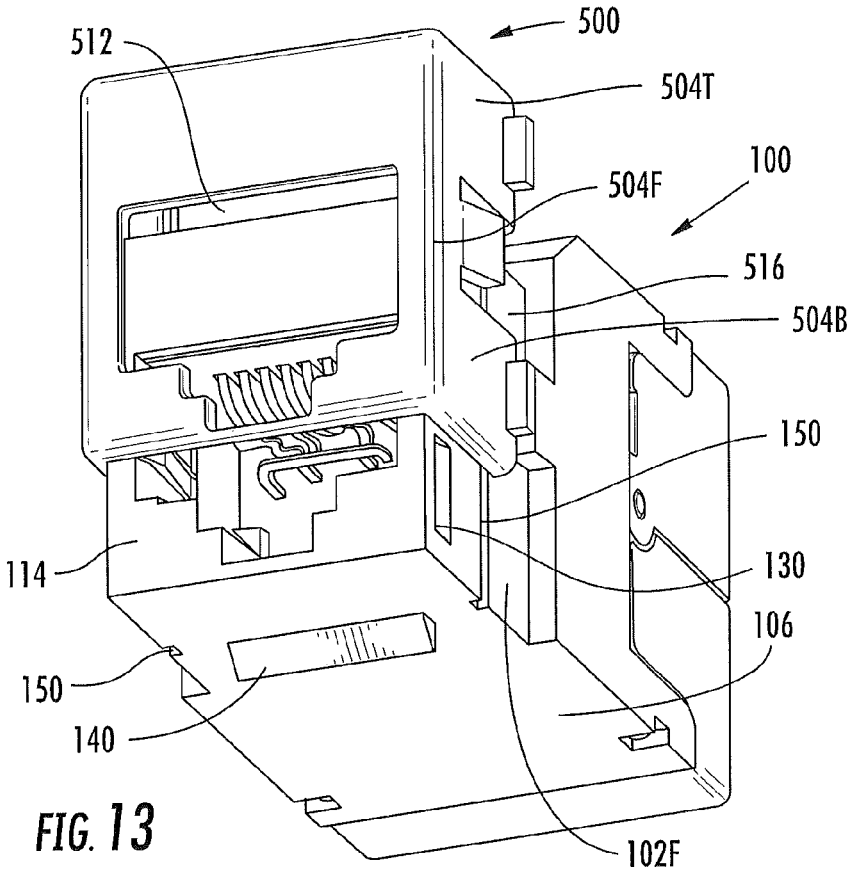
FIG. 13 is bottom front perspective view of an adapter in position to be attached to the communications jack of FIG. 2.
Figure 14:
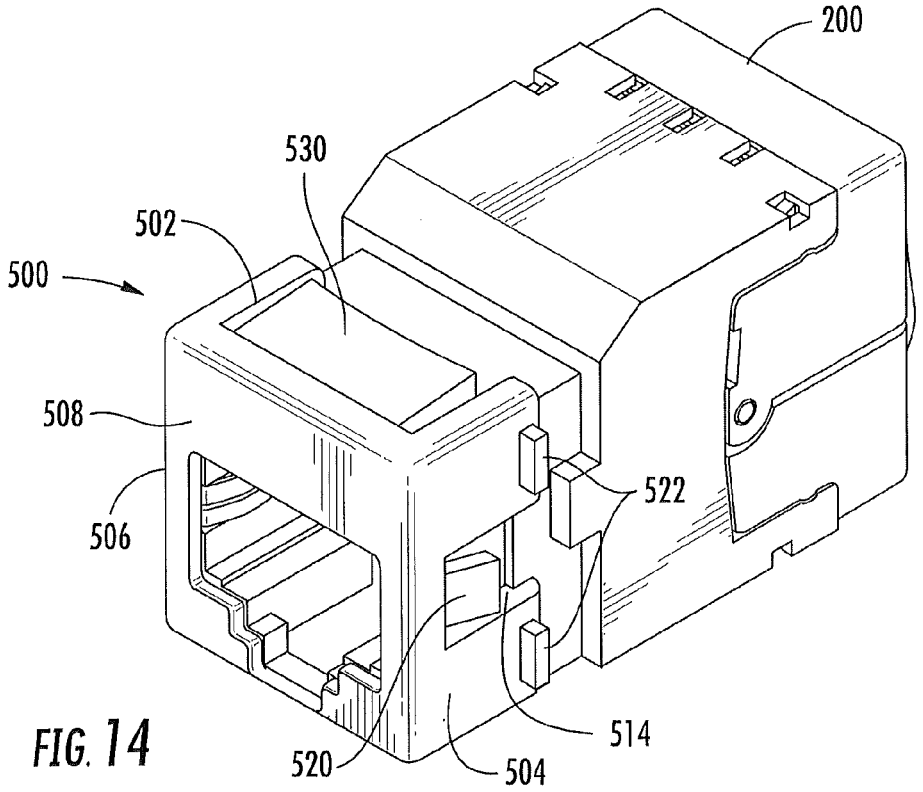
FIG. 14 is a front perspective view of the adapter and communications jack of FIG. 13 in an attached position.

As shown in FIGS. 13 and 14, the adapter 500 includes a top 502 and first and second opposed sides 504, 506. An aperture 512 is defined in a front 508 of the adapter 500.

The jack housing 102 includes a feature or engagement mechanism that engages a structure of the adapter 500 to allow attachment of the adapter 500 to the jack housing 102. For example, as illustrated, each jack housing side surface 108, 110 can include a recess 150 that is configured to receive at least one tab 514 associated with each side 504, 506 of the adapter 500. It will be understood that the feature could be other than the recess 150; for example, the feature could comprise the recesses 130, described above.

The side 504 may include a front section 504F adjacent the front 508 of the adapter 500. The side 504 may also include top and bottom sections 504T, 504B that are separated by opening 516. Each of the top and bottom sections 504T, 504B has a height, and tabs 514 extend inwardly away from inner surfaces of the top and bottom sections 504T, 504B, with each tab 514 extending along at least a major portion of the height of each section. Although not visible in the figures, the second side 506 of the adapter 500 may have the same configuration as the first side 504 of the adapter 500.

The adapter 500 may be attached to the front portion 102F of the jack housing 102 by engaging the tabs 514 and the recesses 150. The adapter 500 may be made of a resilient material such that the first and second sides 504, 506 can be slightly pulled away from one another to assist sliding the adapter 500 over the housing front portion 102F and aligning the tabs 514 with the recesses 150.

When attached, the adapter top 502 extends along at least a portion of a length of the housing top surface 104, the adapter first side 504 extends along at least a portion of a length of the housing first side surface 108, and the adapter second side 506 extends along at least a portion of a length of the housing second side surface 110.

Still referring to FIGS. 13 and 14, a cantilevered arm 520 is attached to or integrated with each of the first and second sides 504, 506 of the adapter 500. As illustrated, the cantilevered arm 520 associated with the first side 504 extends from the front section 504F and extends at least partially into the opening 516. The cantilevered arms 520 may be resiliently deflected inward toward the jack housing 102.

A pair of ledges 522 is also attached to or integrated with each of the first and second sides 504, 506 of the adapter 500. As shown, the ledges 522 associated with the first side 504 are positioned that one of the ledges 522 extends outwardly from an outer surface of the top section 504T and the other of the ledges 522 extends outwardly from an outer surface of the bottom section 504B.

The adapter 500 allows the jack 100 to be mounted in a mounting opening that is different than the aforementioned mounting openings. An example of such a mounting opening is the opening 602 associated with the wall plate 600 shown in FIGS. 15 and 16. It will be understood that an opening similar to opening 602 may be associated with other mounting surfaces, such as patch panels.

Figure 15:
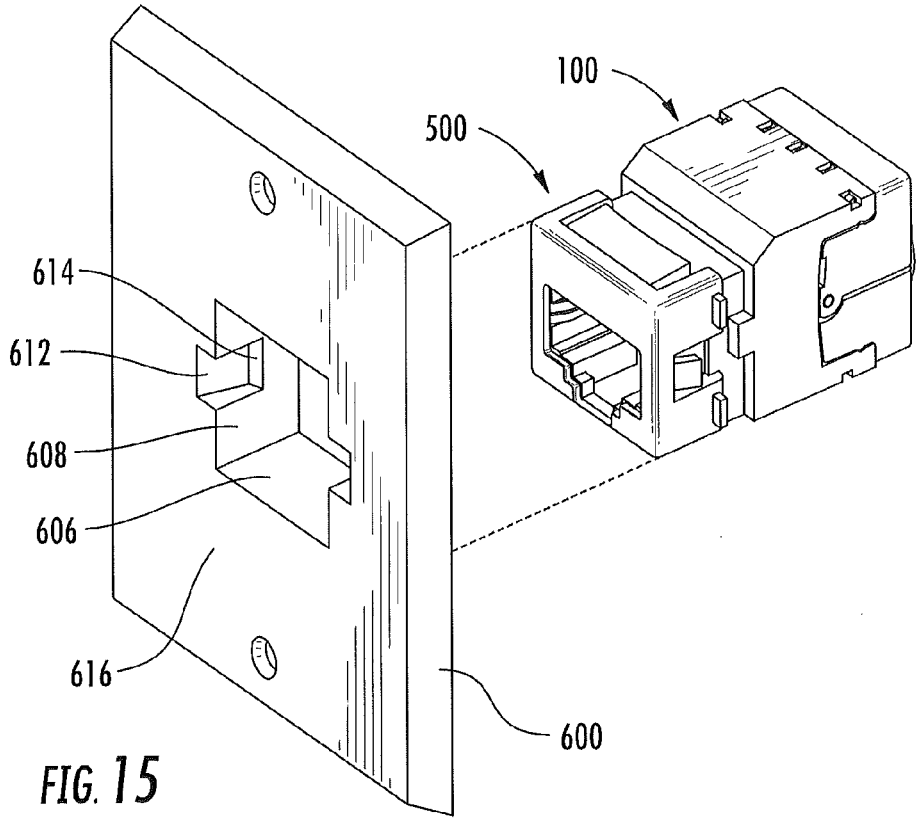
FIG. 15 is a front perspective view of the adapter and communications jack of FIG. 14 in position to be mounted in a mounting opening associated with a wall plate.
Figure 16:
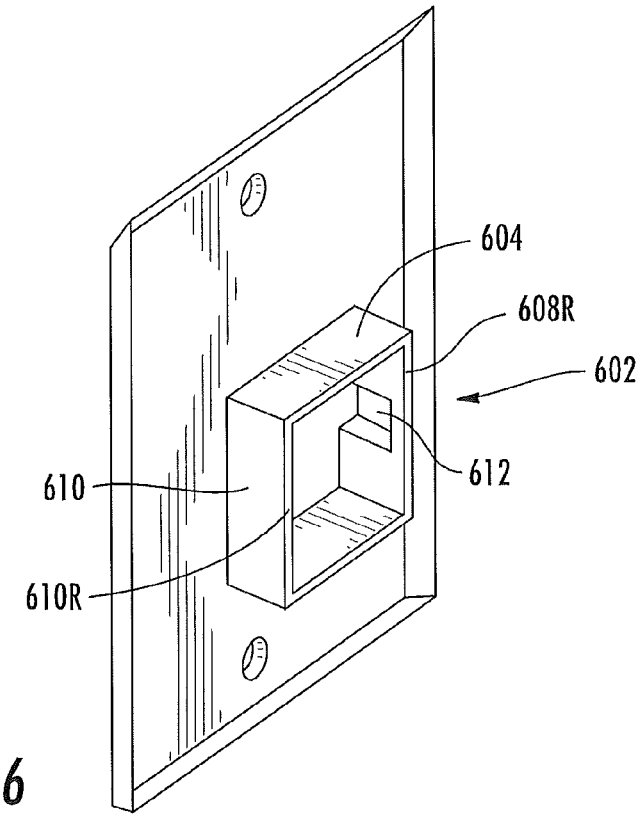
FIG. 16 is a rear perspective view of the wall plate of FIG. 15.

As shown in FIGS. 15 and 16, the jack 100 with the adapter 500 attached thereto may be inserted into opening 602 from the rear of the wall plate 600. The mounting opening 602 can include or be defined by a top wall 604, a bottom wall 606, and opposed side walls 608, 610 that have cut-out areas 612. Each cut-out area 612 may extend from the front 616 of the wall plate 600 rearwardly along a portion of a depth of a respective side wall 608, 610 and define a vertically extending flat portion 614 within the side wall 608, 610.

As the jack 100 with the adapter 500 is mounted into the opening 602 from the rear of the faceplate 600, the cantilevered arms 520 are deflected inwardly by side walls 608, 610 until the cantilevered arms 520 are engaged in respective cut-out areas 612. The cantilevered arms 520 then spring back to their resting position (or return at least partially to their resting position) such that the distal end of each arm 520 rests against a flat vertical portion 614 of a respective cut-out area 612. Thus, the engagement of the cantilevered arms 520 and the cut-out areas 612 inhibits rearward movement of the jack 100 after it has been mounted in the mounting opening 602. Also, the engagement of the cantilevered arms 520 and the cut-out areas 612 may provide tactile and/or audible feedback to indicate that the jack 100 has been properly seated in opening 602.

Moreover, the ledges 522 on the adapter sides 504, 506 may abut rear surfaces 608R, 610R of side walls 608, 610 to prevent the jack 100 from being inserted too far into the opening 602. The cantilevered arms 520 and the ledges 522 of the adapter 500, as well as the various features of the side walls 608, 610 may be configured and positioned such that the front 508 of the adapter may: 1) protrude from the front 616 of the wall plate 600; 2) be flush with the front 616 of the wall plate 600; or 3) be recessed with respect to the front 616 of the wall plate 600 after the jack 100 has been mounted in opening 602.

Turning back to FIGS. 13 and 14, the adapter 500 may include an open bottom such that the bottom surface 106 of the jack housing 102 is exposed for contact with the mounting surface associated with the mounting opening. For example, the open bottom may allow the bottom surface 106 of the jack housing 102 to contact the bottom wall 606 associated with the mounting opening 602 (FIG. 15). Again, the mounting opening may also be associated with a patch panel. As is understood by those of skill in the art, an intelligent patch panel may sense when cables are plugged into, or removed from, jacks mounted in the panel in order to automatically track and record in a computer-based log each change to the patching connectivity. Thus, the open bottom of the adapter 500 may allow for proper sensing in this type of environment.

Moreover, a center wall 530 may be attached to or integrated with the adapter top 502. As illustrated, the center wall 530 may be bowed to urge the jack 100 down against the mounting opening after the jack 100 has been mounted therein. This feature along with the open bottom of the adapter 500 may encourage proper operation when the jack 100 with the adapter 500 attached thereto is mounted into a mounting opening associated with an intelligent patch panel, for example.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An adapter in combination with an RJ-45 communications jack, the RJ-45 communications jack comprising:

a housing having a top surface, a bottom surface, first and second opposed side surfaces, and a plug aperture configured to receive a mating plug at a front of the housing;

wherein at least one of the top surface, bottom surface, first side surface, and second side surface of the housing includes a first feature configured to engage a first mounting structure associated with a first mounting opening to mount the jack in the first mounting opening; and wherein at least one of the top surface and bottom surface of the housing includes a second feature configured to engage an adapter to mount the jack in a second mounting opening that is different than the first mounting opening, wherein the second feature comprises at least one slot positioned at a rear of the housing;

and the adapter including opposite proximal and distal ends, wherein the proximal end includes at least one downwardly extending projection sized and configured to engage the at least one slot, and wherein the distal end includes an upwardly extending latch configured to engage at least a portion of the second mounting opening.

2. The communications jack of claim 1, wherein the first feature is on at least one of the first and second side surfaces of the housing.

3. The communications jack of claim 1, wherein the second feature is on the top surface of the housing.

4. The communications jack of claim 1, wherein the first feature comprises a recess or aperture sized and configured to receive a tab of the first mounting structure associated with the first mounting opening.

5. The communications jack of claim 1, wherein the second mounting opening is a keystone opening.

6. A communications jack assembly, comprising:

an RJ-45 communications jack including a housing having a top surface, a bottom surface, first and second opposed side surfaces, and a plug aperture configured to receive a mating Rj-45 plug at a front of the housing, wherein at least one of the first side surface, the second side surface, the top surface, and the bottom surface of the housing includes a first feature configured engage a first mounting structure associated with a first mounting opening to mount the jack in the first mounting opening;

a first adapter configured to engage a second feature on one of the top and bottom surfaces of the housing to mount the jack in a second mounting opening that is different than the first mounting opening; and a second adapter attachable to the front of the housing to mount the jack in a third mounting opening that is different than the first and second mounting openings.

7. The communications jack assembly of claim 6, wherein the first feature comprises a recess or aperture sized and configured to receive a tab of the first mounting structure associated with the first mounting opening.

8. The communications jack assembly of claim 6, wherein the second mounting opening is a keystone opening.

9. The communications jack assembly of claim 6, wherein the second feature comprises at least one slot positioned at a rear portion of the housing.

10. The communications jack assembly of claim 6, wherein the first adapter includes opposite proximal and distal ends, wherein the proximal end includes at least one projection sized and configured to engage the at least one slot, and wherein the distal end includes a latch configured to engage at least a portion of the second mounting opening.

11. The communications jack assembly of claim 10, further comprising a cable termination manager attachable to the rear of the jack housing to hold the first adapter firmly in place.

12. The communications jack assembly of claim 11, wherein the jack comprises a plurality of insulation displacement contacts (IDCs), each IDC having a slot for receiving therein a conductor, wherein the termination manager comprises a plurality of passageways, each passageway configured to hold therein a conductor, and wherein, when the cable termination manager is attached, each passageway is aligned with a respective IDC.

13. The communications jack assembly of claim 6, wherein the second adapter has a top, first and second opposed sides, and a front defining an aperture, wherein, when attached, the second adapter top extends along at least a portion of a length of the housing top surface, the second adapter first side extends along at least a portion of a length of the first side surface of the housing, the second adapter second side extends along at least a portion of a length of the second side surface of the housing, and the second adapter front aperture substantially aligns with the plug aperture of the housing.

14. The communications jack assembly of claim 13, wherein the housing comprises a third feature comprising a recess on each of the first and second side surfaces of the housing, and wherein each of the first and second sides of the second adapter includes an inwardly extending tab sized and configured to engage at least a portion of a respective recess.

15. The communications jack assembly of claim 13, wherein each of the first and second sides of the second adapter includes a cantilevered arm to engage at least a portion of the third mounting opening.

16. A communications jack assembly, comprising:

an RJ-45 communications jack including a housing having a top surface, a bottom surface, first and second opposed side surfaces, and a plug aperture configured to receive a mating RJ-45 plug at a front of the housing, wherein at least one of the first side surface, the second side surface, the top surface, and the bottom surface of the housing includes a first feature configured engage a first mounting structure associated with a first mounting opening to mount the jack in the first mounting opening; and an adapter configured to engage a second feature on one of the top and bottom surfaces of the housing to mount the jack in a keystone-style mounting opening that is different than the first mounting opening;

wherein the adapter includes opposite proximal and distal ends, wherein the proximal end includes at least one projection sized and configured to engage the at least one slot, and wherein the distal end includes a latch configured to engage at least a portion of the keystone-style opening.

17. The communications jack assembly of claim 16, wherein the first feature comprises a recess or aperture sized and configured to receive a tab of the first mounting structure associated with the first mounting opening.

18. The communications jack assembly of claim 16, wherein the second feature comprises at least one slot positioned at a rear of the housing.

19. The communications jack assembly of claim 16, further comprising a cable termination manager attachable to the rear of the jack housing to hold the adapter in place.

* * * * *